US006045012A

United States Patent [19]

Hansen

[11] Patent Number: 6,045,012

[45] Date of Patent: Apr. 4, 2000

[54] GASOLINE TANK ADAPTER

[76] Inventor: Mark G. Hansen, Box 688, Ignace, Ontario, Canada, P0T 1T0

[21] Appl. No.: 09/057,529

[22] Filed: Apr. 9, 1998

[51] Int. Cl.[7] ..... B67D 5/60

[52] U.S. Cl. ..... 222/464.1; 222/189.1; 222/481; 141/309; 141/382; 114/343

[58] Field of Search ..... 141/65, 285, 309, 141/382; 114/343; 222/189.1, 464.1, 464.2, 478, 481, 562, 563

[56] References Cited

U.S. PATENT DOCUMENTS

| | | | |
|---|---|---|---|
| 2,621,830 | 12/1952 | Stow et al. | 222/464.1 |
| 3,419,193 | 12/1968 | Stewart et al. | 222/464.1 |
| 3,774,813 | 11/1973 | Vanderveen | 222/481 |
| 4,098,218 | 7/1978 | Pichl . | |
| 4,548,344 | 10/1985 | Hestehave et al. . | |
| 4,730,591 | 3/1988 | Gohara et al. . | |
| 4,820,215 | 4/1989 | Mizusawa et al. . | |
| 4,832,237 | 5/1989 | Hurford, Jr. | 222/464 |
| 5,154,213 | 10/1992 | Malamas et al. | 141/382 |
| 5,638,991 | 6/1997 | Todden et al. | 222/189.1 |
| 5,829,494 | 11/1998 | Chiu | 141/312 |

FOREIGN PATENT DOCUMENTS 2041276 4/1991 Canada .

2015887 7/1994 Canada .

OTHER PUBLICATIONS

Packaging for the "Can Adapter"—Date Unknown.

*Primary Examiner*—J. Casimer Jacyna

*Attorney, Agent, or Firm*—Murray E. Thrift; Adrian D. Battison; Michael R. Williams

[57] ABSTRACT

A fuel can adapter is used for adapting standard fuel carrier cans for use as temporary fuel tanks for outboard motors and the like. The adapter has a tapered bung that fits snugly into the necks of all common fuel cans and a peripheral flange at the top end of the bung. The thimble supplied with the fuel can for use on the fuel can neck is threaded onto the neck over the adapter for holding the adapter in place. A fuel passage through the bung is connected at the bottom end with a nipple which is in turn connected to a flexible fuel suction line extending from the bung to the bottom of the can. At the top end of the bung is a conventional fuel tank coupling for connection to the coupling component on the end of an outboard motor fuel line. In preferred embodiments, the bung is equipped with an air passage and a check valve for allowing air to enter the can while preventing the flow of air or fuel from the can.

9 Claims, 2 Drawing Sheets

GASOLINE TANK ADAPTER

FIELD OF THE INVENTION

The present invention relates to the adaptation of conventional fuel carrier cans for use as temporary fuel tanks for outboard and other portable motors.

BACKGROUND

Outboard motors, and some other portable motors, are often supplied with fuel through flexible fuel lines from fuel tanks that are supplied by the motor manufacturer. In many cases the fuel tanks will not carry the full quantity of fuel that may be required, so that fuel carrier cans are often kept on hand to provide the extra fuel for refilling the fuel tank should it run dry. Under some circumstances, it may not be possible or practical to refuel a fuel tank from a fuel carrier can. One example of such a circumstance is in a boat on rough water.

The present invention aims at the provision of a mechanism allowing the use of a common fuel carrier can as a temporary fuel supply tank. Common fuel carrier cans of the relevant type are usually made from moulded plastic material. They have pouring necks with threaded on caps. In most instances, the caps are compound elements that include an auxiliary spout and a thimble for screwing the spout onto the container neck.

SUMMARY

According to one aspect of the invention there is provided an adapter for fuel carrier cans having pouring necks, said adapter comprising:

- a bung having an outer surface of frustoconical shape for engagement in the fuel can necks;
- a flange projecting laterally from the top end of the bung;
- a first fuel line coupling component mounted on the top end of the bung for connection to a second fuel line coupling component;
- a fuel passage through the bung communicating with the first fuel line coupling component; and
- a fuel line connector on a bottom end of the bung, communicating with the fuel passage for connection to a fuel suction line.

The adapter preferably has an air passage through the bung, with a one way valve for admitting air into the can to replace fuel drawn from the can, while permitting fuel and air from flowing out of the can.

The adapter is preferably supplied with a fuel line sufficiently long to extend to the bottom of the common fuel carrier cans.

The tapered outer surface of the adapter is sized to engage inside the necks of most commonly available plastic fuel carrier cans. The thimble part of the cap is then placed over the adapter and screwed onto the neck to hold the adapter in place.

For the larger sizes of can necks, the adapter may have a seal ring under the flange and around the top of the tapered surface to engage and seal against the end of the neck.

Fuel line couplings used on commercially available fuel tanks can be installed on the bung, providing a direct connection to the mating coupling component on the fuel line for the motor.

BRIEF DESCRIPTION OF THE DRAWINGS

In the accompanying drawings, which illustrate an exemplary embodiment of the present invention.

DETAILED DESCRIPTION

Figure 1:
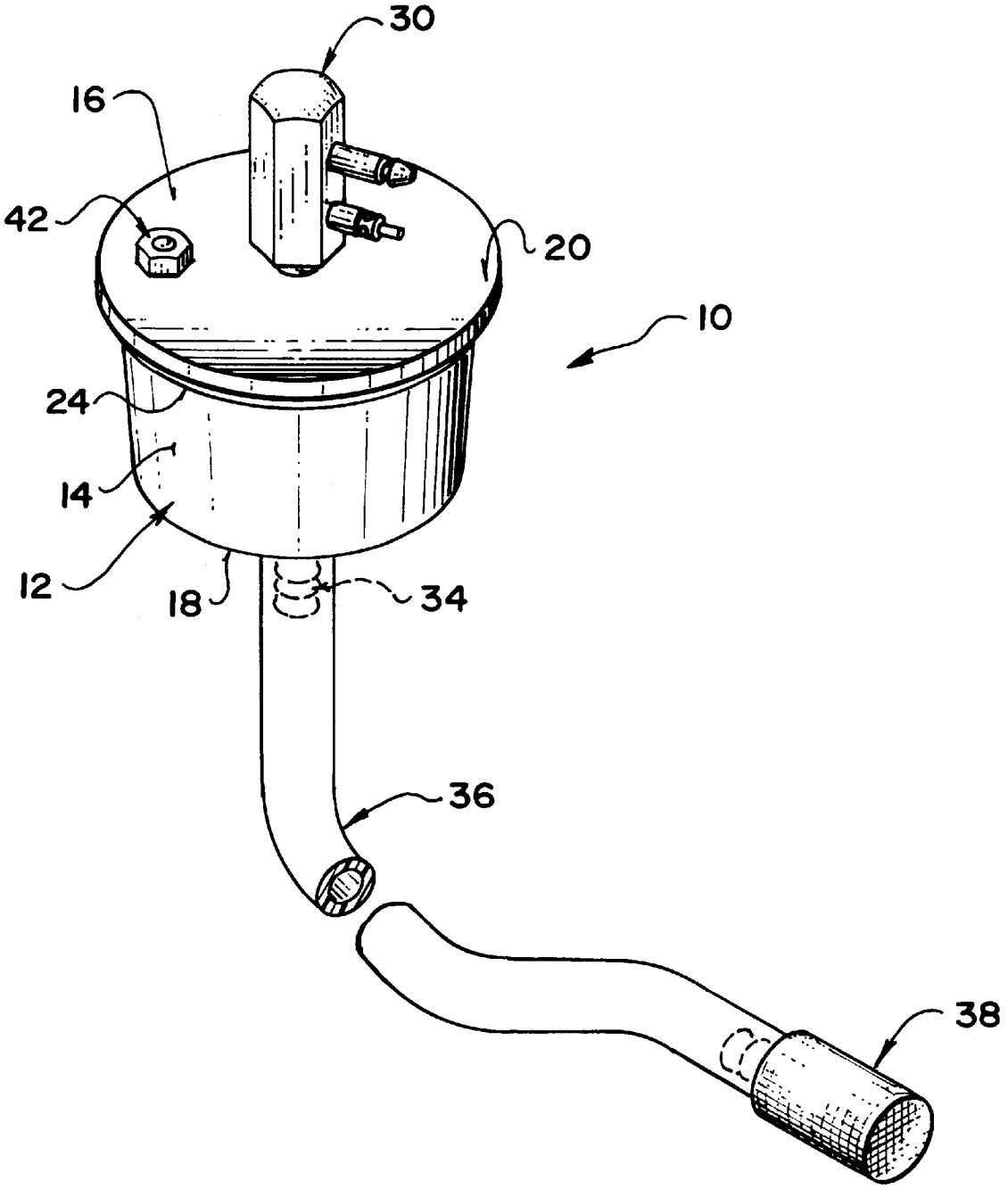
FIG. 1 is an isometric view of the adapter according to the present invention.
Figure 2:
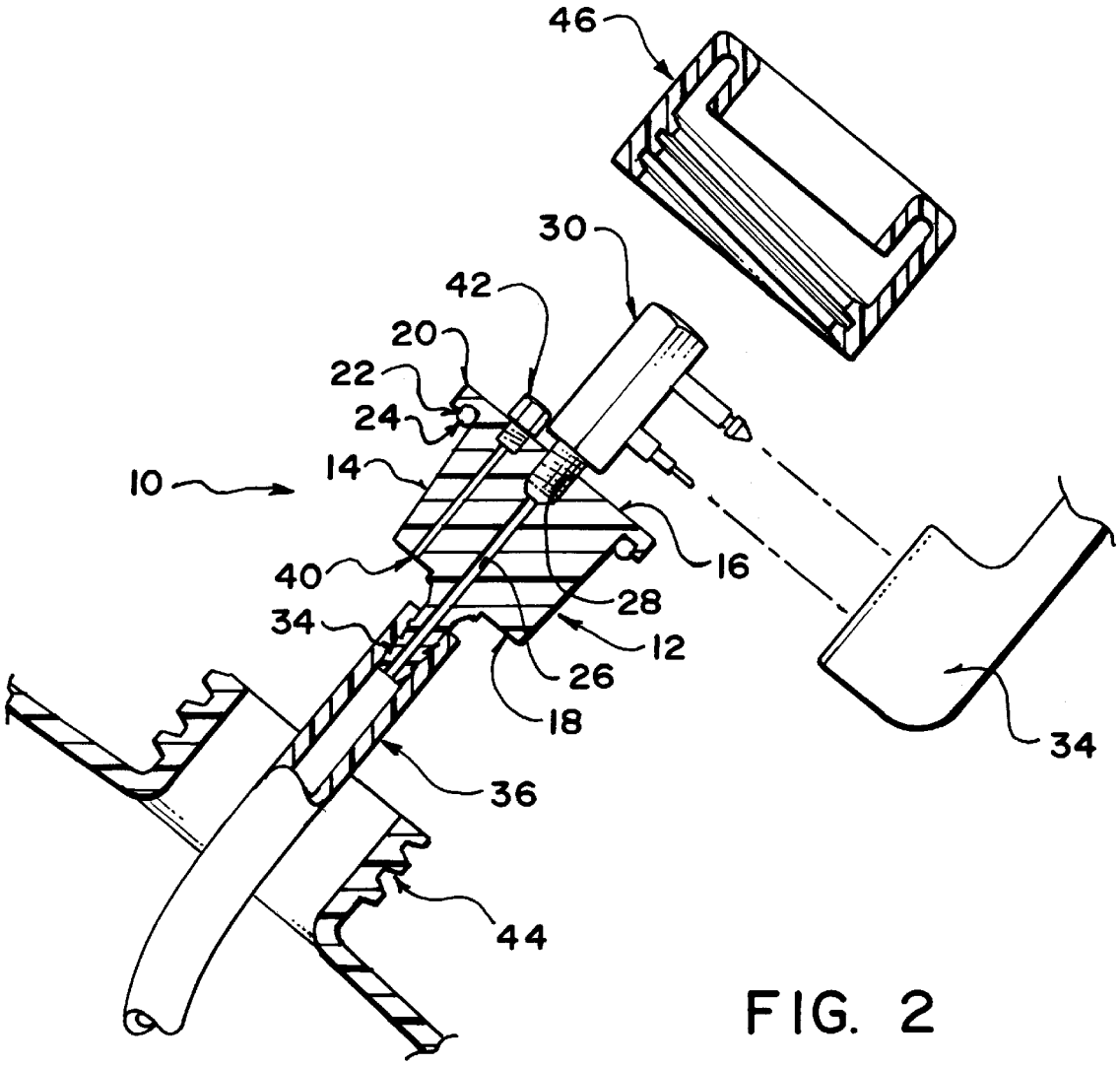
FIG. 2 is a cross section of the adapter.

Referring to the accompanying drawings, there is illustrated an adapter 10 for converting a standard fuel carrier can for use as a temporary fuel tank. The adapter includes a bung 12 with a frustoconical outer surface 14 tapering from the top end 16 to the bottom end 18 of the bung. The diameter of the adapter and the taper angle are selected such that the bung will fit snugly into the necks of the commonly available fuel carrier cans.

At the top end of the bung is a peripheral, laterally projecting flange 20. On the under side of the flange is an annular groove 22 that serves as a seat for an O-ring 24. The O-ring will engage against the ends of the larger sizes of neck with which the adapter is to be used.

A fuel passage 26 runs through the bung from the top end to the bottom end. At the top end it has a threaded counterbore 28 into which a fuel line coupling component 30 is screwed. The coupling component 30 is a standard component that engages a second coupling component 32 for delivering fuel to a motor fuel line.

On the bottom end of the bung is a nipple 34 that serves as a connector for a flexible fuel suction line 36 that is sufficiently long to reach to the bottom of the fuel carrier cans with which the adapter is to be used. At the inlet end of the fuel suction line is a strainer element 38.

The bung 12 also has a through air passage 40 extending from the top end 16 to the bottom end 18. At the top end of the bung, the air passage is equipped with a check valve 42 that allows air to pass through the bung from the top to the bottom, while preventing the passage of air and fuel from the bottom to the top. This admits air into the can to replace fuel drawn out during use as a fuel tank, while leaving the can sealed against leakage through an open air vent.

In use, the fuel line 36 and strainer 38 are inserted into the neck 44 of a fuel can, the bung 12 is engaged in the neck and held in place using the thimble 46 that is supplied with the can. This provides a complete adaptation of the fuel can for use as a temporary fuel tank.

While one embodiment of the present invention has been described in the foregoing, it is to be understood that other embodiments are possible within the scope of the invention and are intended to be included herein. The invention is to be considered limited solely by the scope of the appended claims.

I claim:

1. An adapter for fuel carrier cans having pouring necks, said adapter comprising:

- a bung having an outer surface of frustoconical shape adapted for sealing engagement in the fuel can necks along the frustoconical surface;
- a flange projecting laterally from the top end of the bung;
- a first fuel line coupling component mounted on the top end of the bung for connection to a second fuel line coupling component;
- a fuel passage through the bung communicating with the first fuel line coupling component; and
- a fuel line connector on a bottom end of the bung, communicating with the fuel passage for connection to a fuel suction line.

2. An adapter according to claim 1 including an air passage through the bung from the top end to the bottom end.

3. An adapter according to claim 2 including a check valve in the air passage for allowing air to pass through the bung from the top end to the bottom end.

4. An adapter according to claim 3 including an annular seal surrounding the outer surface of the bung adjacent the flange.

5. An adapter according to claim 4 including a flexible fuel suction line with a delivery end connected to the fuel line connector.

6. An adapter according to claim 5 including a fuel strainer connected to an inlet end of the flexible fuel suction line.

7. An adapter according to claim 1 including an annular seal surrounding the outer surface of the bung adjacent the flange.

8. An adapter according to claim 7 including a flexible fuel suction line with a delivery end connected to the fuel line connector.

9. An adapter according to claim 8 including a fuel strainer connected to an inlet end of the flexible fuel suction line.

* * * * *